United States Patent [19]

Keister

[11] Patent Number: 5,018,417

[45] Date of Patent: May 28, 1991

[54] GRAPHIC TAPE SLICER

[76] Inventor: Larry V. Keister, 3175 Rocky Point Rd., Springfield, Ohio 45502

[21] Appl. No.: 409,141

[22] Filed: Sep. 19, 1989

[51] Int. Cl.[5] ..... B26D 5/22

[52] U.S. Cl. ..... 83/156; 83/353; 83/354; 83/428; 83/522.019; 83/614; 83/631; 83/359

[58] Field of Search ..... 83/353, 614, 485, 522.19, 83/350, 354, 581, 631, 373, 156, 428, 368

[56] References Cited

U.S. PATENT DOCUMENTS

| | | | |
|---|---|---|---|
| 2,561,097 | 7/1951 | Cleaver | 83/156 |
| 3,079,827 | 3/1963 | Costelli | 83/614 |
| 3,319,500 | 5/1967 | Wild et al. | 83/353 |
| 4,283,976 | 8/1981 | Wennerström | 83/428 X |
| 4,335,636 | 6/1982 | Porter | 83/353 X |
| 4,557,169 | 12/1985 | Kajiya et al. | 83/156 |
| 4,674,375 | 6/1987 | Golicz | 83/156 X |
| 4,824,515 | 4/1989 | Still et al. | 83/614 X |

*Primary Examiner*—Frank T. Yost

*Assistant Examiner*—Kenneth E. Peterson

*Attorney, Agent, or Firm*—Quirk, Tratos & Roethel

[57] ABSTRACT

The graphic tape slicer comprises a frame having a feed guide at the rear end for receiving the graphic tape from a roll. A cutting blade is mounted in the center of the frame on a traveling blade holder that engages a threaded rod. Rollers through which the tape is extracted are mounted on the front of the frame. The extraction rollers are joined by a pulley arrangement to the threaded rod. When the graphic tape is extracted from the slicer, the front drive rollers rotate which, through the action of the pulleys, causes the threaded rod to rotate. This causes the blade to move along the threads of the threaded rod. This movement effects the cutting blade to move across the width of the graphic tape causing a resulting length of graphic tape being cut at an oblique angle. By disengaging the pulley arrangement, the blade can be positioned in a fixed location along the length of the threaded rod which will result in a straight cut along the length of the graphic tape.

47 Claims, 5 Drawing Sheets

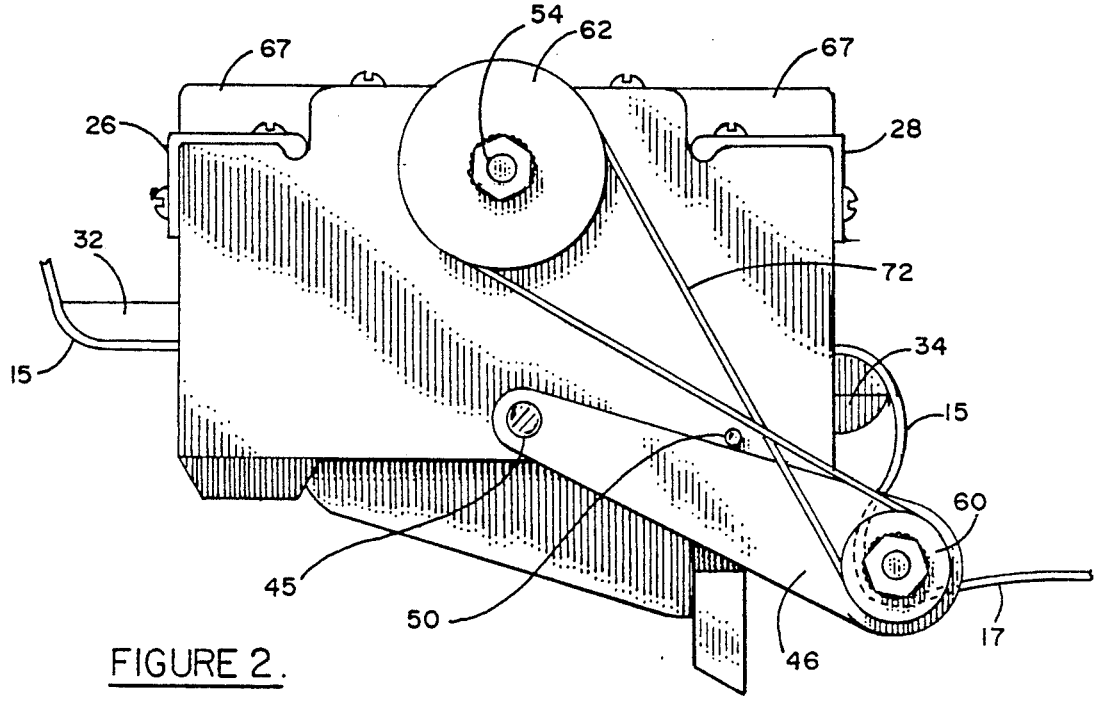
FIGURE 2.
FIGURE 3.
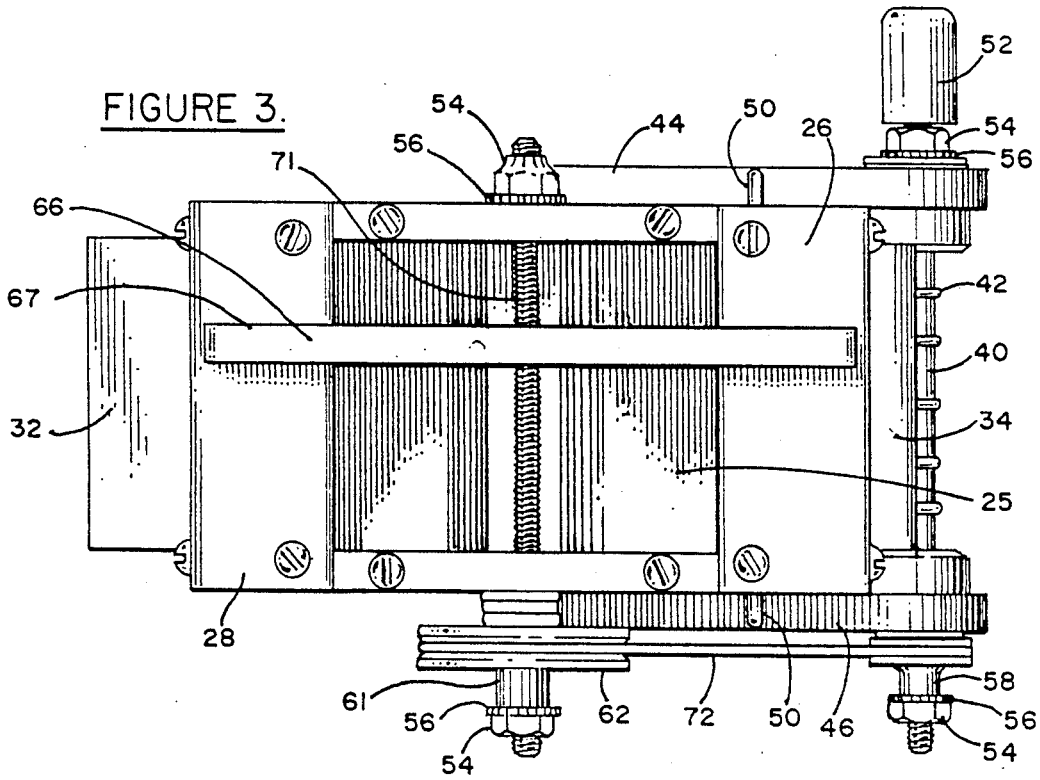

FIGURE 5.
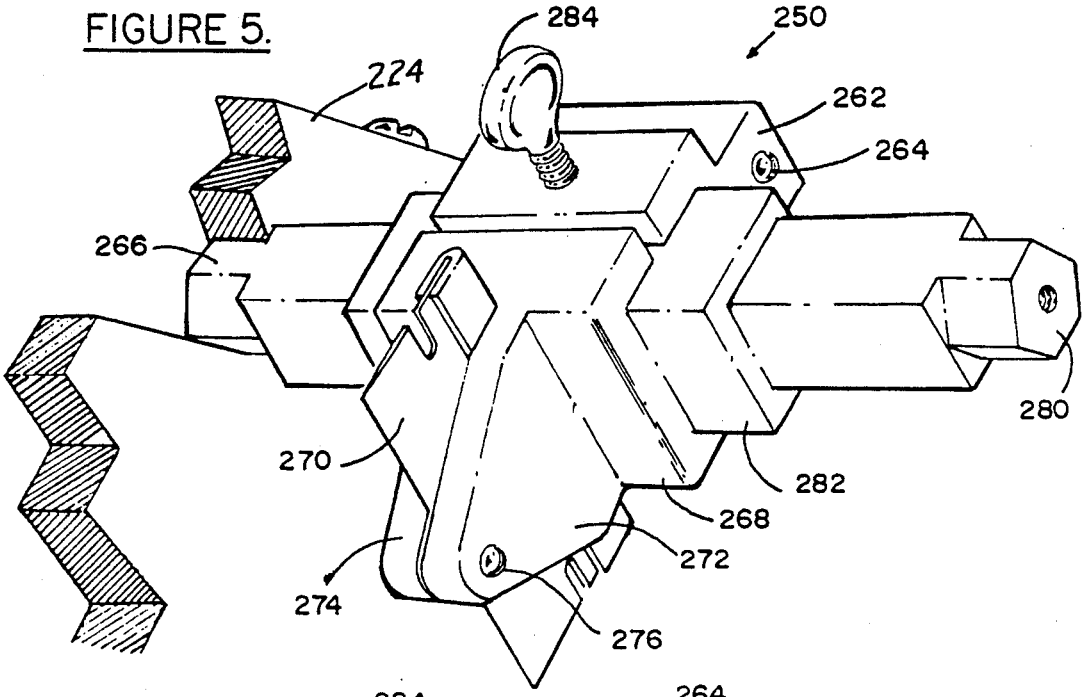
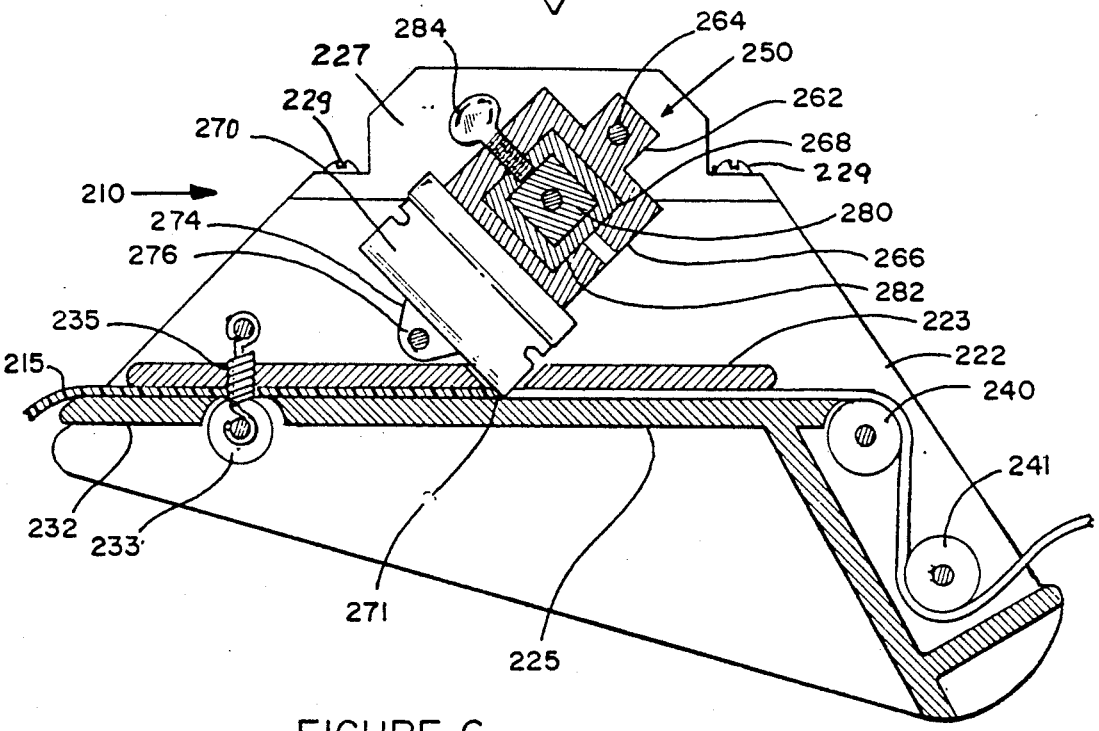
FIGURE 6.

GRAPHIC TAPE SLICER

BACKGROUND OF THE INVENTION

This application relates to a graphic tape slicer, and more particularly to a graphic tape slicer that automatically cuts graphic tape at either an oblique angle or in a straight line.

Graphic tape with an adhesive backing has been used for many years to decorate and enhance the visual beauty of many products. It has become popular to apply graphic tape to the metal exterior of vehicles, including passenger cars, pickup trucks and vans. Initially, the craftsman would lay the graphic tape out on a table and cut the graphic tape by hand to the size and shape necessary to produce the design.

Recently, graphic tape slicers have begun to appear. A product known as the Universal slitter uses a clear, plastic rectangular guide through which the graphic tape to be sliced is pulled. The craftsman holds a razor blade or other cutting implement in a guide opening with one hand while pulling the graphic tape with the other hand.

Another graphic tape slicer is made by Sharpline Converting Inc. and is sold under the product name Exactatrim. This device has a holder that supports a roll of graphic tape. A cutting implement, such as a razor blade, is disposed on the edge of the holder and the position of the blade is set using a thumb screw. The graphic tape is then pulled through the cutting area to effect the cut. A second knife is provided to make two cuts at once.

Yet another model is made by Exciters Graphic Design, the model sold under the name Slit-er. This model rests horizontally on a flat surface. A graphic tape guide is provided that uses one or two blades to make single or double cuts. The width of the cuts is adjustable.

Finally, a product known as the Accu-Slitter TM, made by Arlon, has a cutting blade mounted in a frame. The cutting blade is adjustable for varying width cuts and a separate guide member is utilized to accommodate different sizes of graphic tapes.

One of the disadvantages of these devices is that only straight cuts can be made. In order to do the most creative and artistic designs that the consumer is currently demanding, it is often necessary to cut the graphic tape at an oblique angle or along a diagonal to create tapers in the tape.

It is an object of the present invention to provide a graphic tape slicer that will cut tape at an oblique angle, preferably in either direction or in alternating directions. It is a further object of the present invention to provide a graphic tape slicer that can also be used to make straight cuts.

It is a feature of the present invention that a graphic tape slicer is provided with a cutting blade that is mounted on a screw thread so that the action of the graphic tape being pulled through the slicer effects a traveling action of the blade across the width of the graphic tape to produce a tape cut at an oblique angle. The graphic tape slicer can also be adjusted to disengage the traveling action of the blade to permit straight cuts to be made.

It is an advantage of the present invention that graphic tape can be cut in either a straight line, at an oblique angle, at an opposite oblique angle, in alternating oblique angles or in combinations of oblique angles and straight lines thereby permitting the craftsman to achieve a multitude of creative and artistic designs.

SUMMARY OF THE INVENTION

The graphic tape slicer of the present invention comprises a frame having a feed guide at the rear end for receiving the graphic tape from a roll. A cutting blade is mounted in the center of the frame and is connected to a moveable member that engages a threaded rod. Drive rollers through which the tape is extracted are mounted on the front of the frame. The drive rollers are joined by a pulley arrangement to the threaded rod. When the graphic tape is extracted from the slicer, the front drive rollers rotate which, through the action of the pulleys, causes the threaded rod to rotate. This causes the blade to move along the threads of the threaded rod. This movement causes the cutting blade to move across the width of the graphic tape causing a resulting length of graphic tape being cut at an oblique angle. By disengaging the pulley arrangement, the blade can be positioned in a fixed location along the length of the threaded rod which will result in a straight cut along the length of the graphic tape. By changing the direction of rotation of the threaded rod, an opposite oblique cut can be made. By continually reversing the direction of rotation and/or intermittently stopping the rotation of the threaded rod, a length of graphic tape can created that has alternating oblique angles or combinations of oblique angles and straight line cuts.

The graphic vinyl tape used in the present invention is preferably 2 mil or 4 mil thickness tape as in conventionally used in the recreational vehicle and signage industries. One side of the tape has a sticky exterior to permit the adhesion of the tape, once it has been cut to shape, to the product to be decorated. The sticky side of the tape is generally covered by a thin piece of paper during the shaping and cutting of the tape to size. The removal of the piece of paper backing readies the tape of adhesion to the product to be decorated.

BRIEF DESCRIPTION OF THE DRAWINGS

FIG. 2 shows a left side view of the graphic tape slicer of the present invention.

FIG. 3 shows a top view of the graphic tape slicer of the present invention.

FIG. 5 shows a perspective view of a portion of an alternative embodiment of the graphic tape slicer of the present invention.

FIG. 6 shows a side interior section view of an alternative embodiment of the graphic tape slicer of the present invention.

DETAILED DESCRIPTION OF THE PREFERRED EMBODIMENTS

Figure 1:
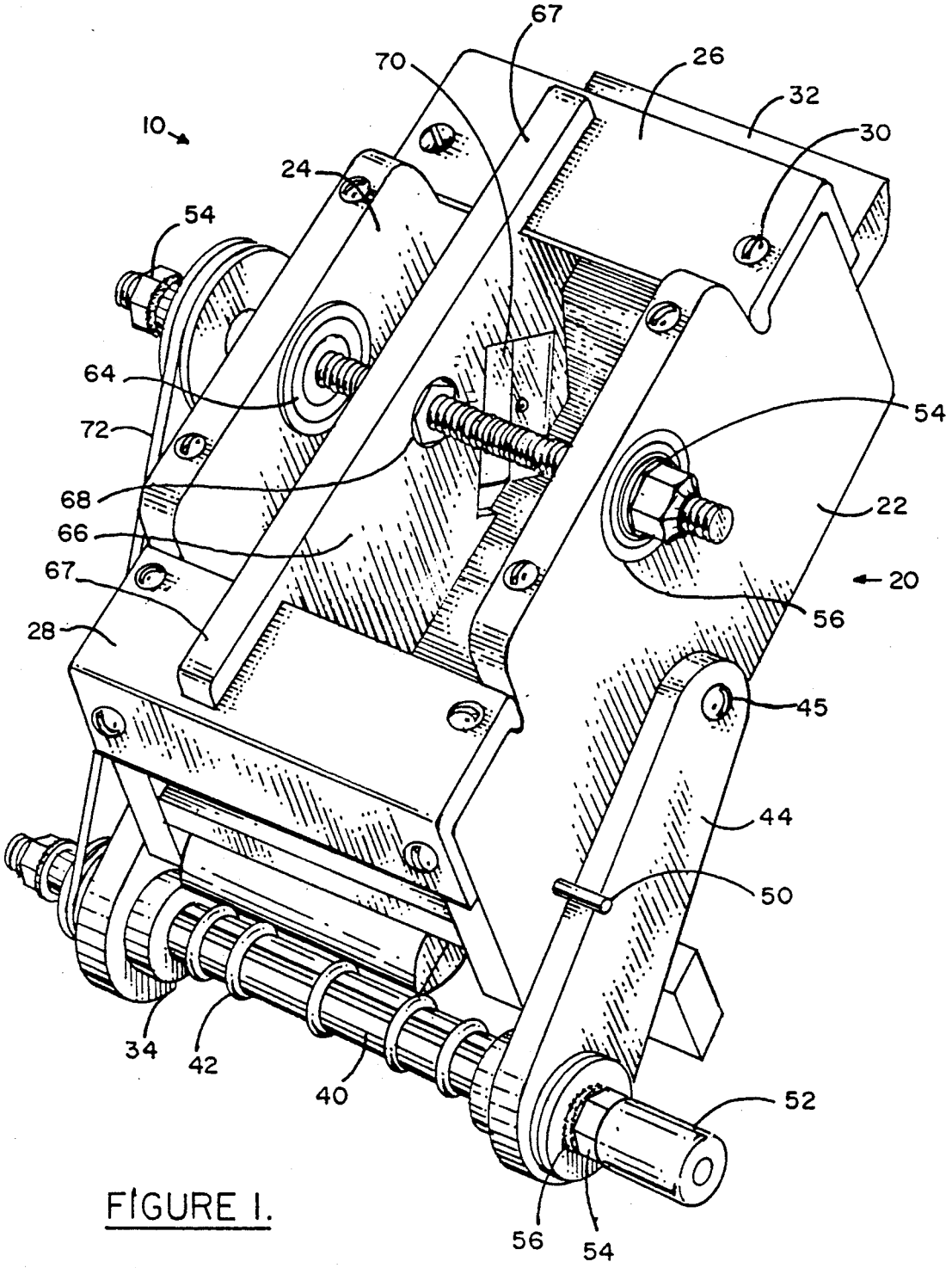
FIG. 1 shows in perspective view the graphic tape slicer of the present invention.
Figure 4:
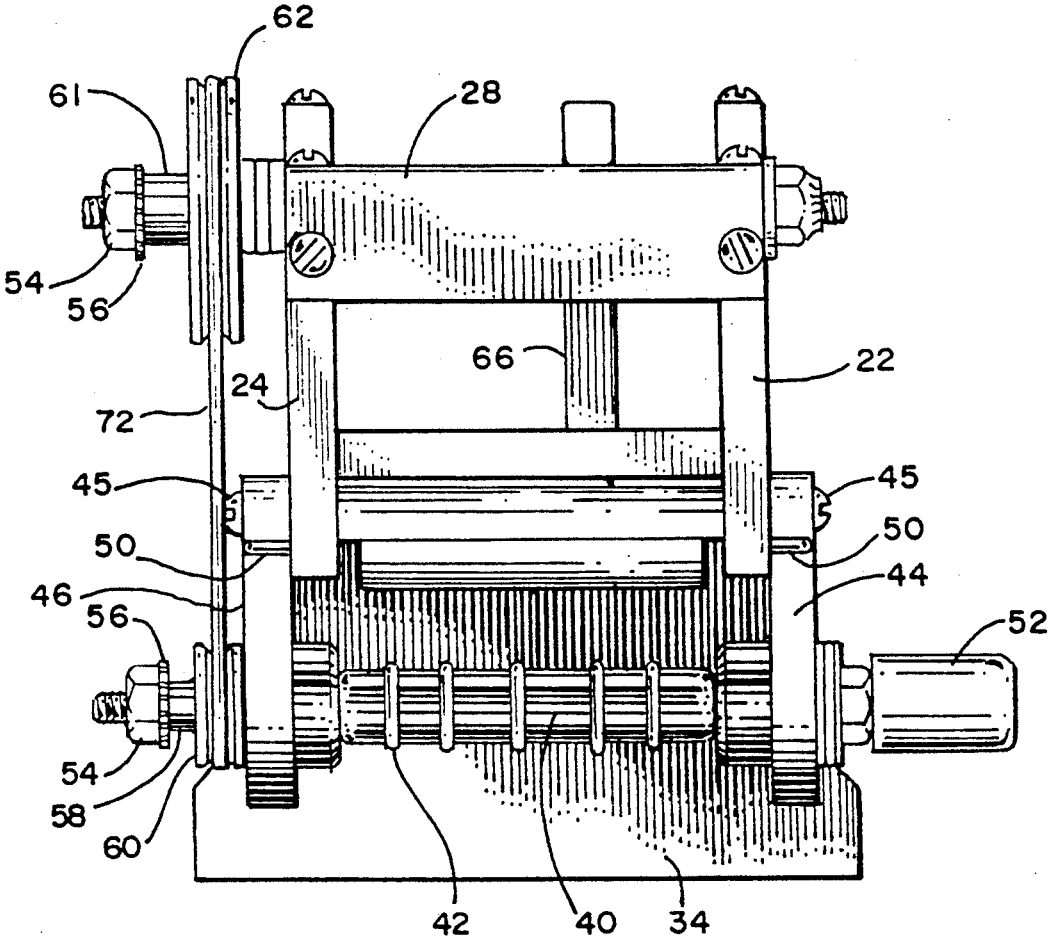
FIG. 4 shows a front view of the graphic tape slicer of the present invention.

The graphic tape slicer of the present invention is shown generally at 10 in FIG. 1. The graphic tape slicer 10 comprises a generally rectangular frame 20 that includes a right side wall 22 and a left side wall 24. At the rear end of the graphic tape slicer 10 is a back cross support 26 and at the forward end of the graphic tape slicer 10 is a front cross support 28. Both the back cross support 26 and the front cross support 28 are secured to the right side wall 22 and the left side wall 24 by suitably fastening means, such as screws 30. At the rear of the graphic tape slicer 10, between the right side wall 22 and the left side wall 24 and below the back cross support 26, there is provided a rear tape guide 32 which guides the graphic tape to be sliced into the rectangular frame 20. At the front of the graphic tape slicer 10, between the right side wall 22 and the left side wall 24 and below the front cross support 28, there is provided a front tape guide 34 which guides the graphic tape out of the rectangular frame 20 after it has been sliced.

Adjoining the front tape guide 34, a tape extraction roller 40 is mounted to the rectangular frame 20 by means of a right roller support 44 and a left roller support 46. The tape extraction roller 40 has a plurality of friction rings 42 spaced along the length of the tape extraction roller 40 to provide for additionally gripping action to the graphic tape as will be more fully explained herein. One end of the right roller support 44 is pivotally attached to the right side wall 22 at pivot point 45 by means of suitable attachment means, such as a screw. The other end of the right roller support 44 has an opening therein for rotatably receiving the tape extraction roller 40.

Similarly, the left roller support 46 is also pivotally attached to the left side wall 24 at pivot point 47 by means of suitable attachment means, such as a screw. The other end of the left roller support 46 has an opening therein for rotatably receiving the tape extraction roller 40. The upward movement of the right roller support 44 and the left roller support 46 are each limited by means of a limit post 50 mounted on the right side wall 22 and the left side wall 24, respectively.

The right end portion of the tape extraction roller 40 extends beyond the right roller support 44 and is secured by means of a washer 56 and a nut 54. At the end of the tape extraction roller 40, a handle 52 is mounted therein to allow manual rotation of the tape extraction roller 40. The left end portion of the tape extraction roller 40 also extends beyond the left roller support 46 and, as shown in FIG. 3, is secured by means of a washer 56 and a nut 54. Intermediate the washer 56 and the left side wall 24, the tape extraction roller 40 is provided with a roller extension 58 on which is mounted a bottom pulley 60. The bottom pulley 60 associates by way of a drive belt 72 with the top pulley 62 to drive the threaded rod 64 as will be more fully explained herein.

A threaded rod 64 is disposed between the right side wall 22 and the left side wall 24 and is journalled for rotation in suitable bearings or other conventional journalling means. The top pulley 62 is mounted at the left end of the threaded rod 64 and secured thereto by a nut 54 and a washer 56. The top pulley 62 is positioned at the appropriate location on the threaded rod 64 outside the left side wall 24 by means of a spacer 61.

The threaded rod 64 carries a blade support 66 which is attached to the threaded rod 64 by a threaded nut 68 mounted in the body of the blade support 66. Each end of the blade support 66 has a blade support arm 67 that rides along the top of the back cross support 26 and the front cross support 28, respectively, and provides lateral support for the blade support 66. A cutting blade 70 is fixedly attached to the blade support 66 and positioned so that the cutting edge of the cutting blade 70 can be operatively associated with a length of graphic tape 15 being fed through the graphic tape slicer 10.

The operation of the graphic tape slicer 10 shown in FIGS. 1–4 is as follows. The blade support 66 is initially positioned at one interior end of the threaded rod 64 between the insides of right side wall 22 and left side wall 24. A length of graphic tape 15 is manually fed into the rear of the graphic tape slicer 10, under the rear tape guide 32, under the cutting blade 70, out the top of the front tape guide 34 and back under the tape extraction roller 40 as shown in FIG. 2. The height of the cutting blade 70 is positioned to engage the graphic tape 15 to make the appropriate depth of cut. For example, the tape can be cut all the way through the vinyl material that forms the decorative tape and also all the way through the paper backing that covers the sticky side of the graphic tape 15. Alternatively, the cutting blade can be positioned to only cut through the vinyl material but not to cut the paper backing. This alternative height cut is known in the business as a "kiss" cut.

The operator then grasps the front end 17 of the graphic tape 15 and slowly pulls the graphic tape 15 through the graphic tape slicer 10. This pulling action causes the tape extraction roller 40 to rotate which through the action of the drive belt drive belt 72 also causes the top pulley 62 to rotate. Slippage of the graphic tape 15 on the roller 40 is prevented by the friction rings 42. The rotation of the top pulley 62 causes the threaded rod 64 to rotate which, due to the engagement of the threaded nut 68 with the blade support 66, causes the blade support 66 to move along the length of the threaded rod 64 from one side of the graphic tape slicer 10 to the other. The cutting blade 70 is thus translated from left to right, or vice versa depending on the direction of rotation and/or the pitch of the threads on the threaded rod 64. This lateral movement of the cutting blade 70 will cause a diagonal or oblique angle cut to be made in the graphic tape 15.

If the graphic tape 15 is too fragile to be pulled by hand through the graphic tape slicer 10, the handle 52 can be used to turn the tape extraction roller 40 thereby effecting movement of the cutting blade 70. The direction of movement of the cutting blade 70 can be changed at any time by simply criss-crossing the drive belt 72 between the bottom pulley 60 and the top pulley 62. For example, FIG. 1 depicts the drive belt 72 in a non-criss-crossed configuration which causes the threaded rod 64 to rotate in the same direction as the tape extraction roller 40. In FIG. 2, the drive belt 72 has been criss-crossed which will result in the threaded rod 64 turning in an opposite direction to that of the rotation of the tape extraction roller 40. By varying the size of either the bottom pulley 60 or the top pulley 62, the speed at which the cutting blade 70 traverses across the tape can be varied thereby changing the angle of the diagonal cut on the graphic tape 15. A change in the pitch on the threaded rod 64 will also vary the angle of the cut.

Another embodiment of the present invention is shown in FIGS. 5 and 6. The cutting blade 270 is carried in a cutting blade holder 250. The cutting blade holder 250 is mounted on a guide bar 280 which is disposed between the right side wall 222 (FIG. 6) and the left side wall 224 (FIG. 5) of the graphic tape slicer 10. Each end 266 of the guide bar 280 is beveled, preferably into a hexagonal cross-section as shown, to allow the guide bar 280 to be securely fastened into an appropriate aperture in each side wall. As shown in FIG. 6, the upper section 227 of the right side wall 222 is removable from the remainder of the right side wall 222 to allow placement of the beveled end 266 of the guide bar 280 in the right side wall 222. Screws 229 or other suitable fastening means as used to secure the upper section 227 to the remainder of the right side wall 222. A similar arrangement is used on the left side wall 224.

The cutting blade holder 250 comprises an upper guide frame 262 and a lower guide frame 268 which are held together by screws (not shown). The upper guide frame 262 and the lower guide frame 268 clamp together around an interior bushing 282 which extends laterally along the guide bar. The interior bushing 282 is slightly longer than the width of the cutting blade holder 250 and the interior bushing 282 slides along the surface of the guide bar 280 during the lateral translation of the cutting blade 270. The threaded rod 264 is mounted to the cutting blade holder 250 through an interior threaded passageway in the upper portion of the upper guide frame 262. The upper guide frame 262 cooperates with the threaded rod 264 to effect the lateral movement of the cutting blade holder 250 along the length of the guide bar 280 to allow the diagonal cut in the graphic tape 215 to be made.

The lower guide frame 268 has mounted thereon a right side blade holder 272 and a left side blade holder 274 between which is disposed the cutting blade 270. The cutting blade 270 is positioned at the appropriate height and then held in place by a blade positioning set screw 276.

The operation of this embodiment is depicted in FIG. 6. The graphic tape 215 enters the rear end of the graphic tape slicer 210 over the top of the rear tape guide 232. The graphic tape 215 is supported on its lower side by the bottom tape guide 225 and the tautness of the graphic tape 215 is maintained by a tension roller 233 through the action of a tension spring 235. The upper surface of the graphic tape 215 is guided by the top tape guide 223 which also is provided with a lateral blade channel 271 to guide the movement of the cutting blade 270 from one side of the graphic tape slicer 210 to the other. As the graphic tape 215 exits the graphic tape slicer 210, the front drive roller 240 rotates through the action of the pulley arrangement depicted in FIGS. 1-4 and effects the rotation of the threaded rod 264 which causes the lateral movement of the cutting blade holder 250 along the guide bar 280 to create the diagonal cut in the graphic tape 215.

This embodiment further allows a precise straight cut to be made in the graphic tape 215. The operator selects the location along the width of the graphic tape 215 at which he desires a straight cut to be made. The cutting blade 270 blade is laterally positioned manually at that point along the length of the guide bar 280 and the upper guide frame 262 is tightened securely to the guide bar 280 by means of set screw 284 to hold the cutting blade 270 in place at that point. The operator then simply removes the drive belt from the pulley arrangement so that as the graphic tape 215 is pulled through the cutting area there will be no lateral movement of the cutting blade 270 and a straight cut will result. Thus a skilled operator can effect a multitude of combinations of diagonal cuts in either direction and straight cuts by simply manipulating the drive belt and the set screw 284.

Figure 7:
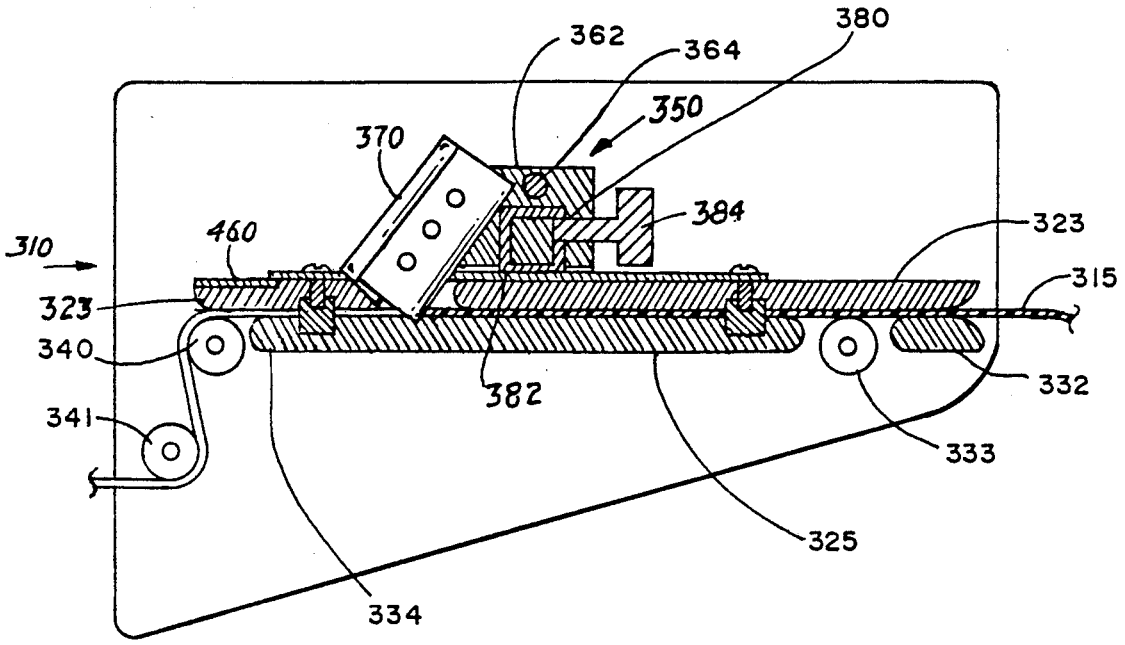
FIG. 7 shows a side interior section view of another alternative embodiment of the graphic tape slicer of the present invention.

Another embodiment of the present invention is shown in FIG. 7. This embodiment accommodates an Olfa-type blade instead of the razor-type blade used in the other embodiments. The graphic tape slicer 310 comprises a cutting blade holder 350. The cutting blade 370 is a conventional Olfa-type blade that is oriented generally vertically in the cutting blade holder 350. The vertical position of the cutting blade 370 can be adjusted to provide either a full cut or a kiss cut. The cutting blade holder 350 includes an interior bushing 382 that is mounted about a guide bar 380 which is positioned between the side walls of the graphic tape slicer 310. The guide bar 380 has a threaded rod support member 362 mounted thereon that cooperates with the threaded rod 364 to cause the cutting blade holder 350 to move lengthwise along the threaded rod 364 to provide diagonal cuts in the graphic tape 315. A set screw 384 is used to tighten the cutting blade holder 350 to the guide bar 380 and securely hold the cutting blade holder 350 in a fixed lateral position to effect straight cuts in the graphic tape 315.

In operation, the graphic tape 315 is fed into the rear of the graphic tape slicer 310 over the top of the rear tape guide 332, past the tension roller 333 and under a top tape guide 323. The bottom of the graphic tape 315 is supported by the bottom tape guide 325. At the front of the graphic tape slicer 310, the 315 passes over the front tape guide 334 and the front drive roller 340 and under a front idler roller 341. As the graphic tape 315 is pulled through the graphic tape slicer 310, the front drive roller 340 causes the pulley arrangement (not shown) to cause the cutting blade holder 350 to move across the width of the graphic tape 315 to effect a diagonal cut. By disconnecting the drive belt and securing the cutting blade holder 350 to the guide bar 380 by means of the set screw 384, the cutting blade 370 can be held in a fixed lateral position to cause a straight cut to be made.

Figure 8:
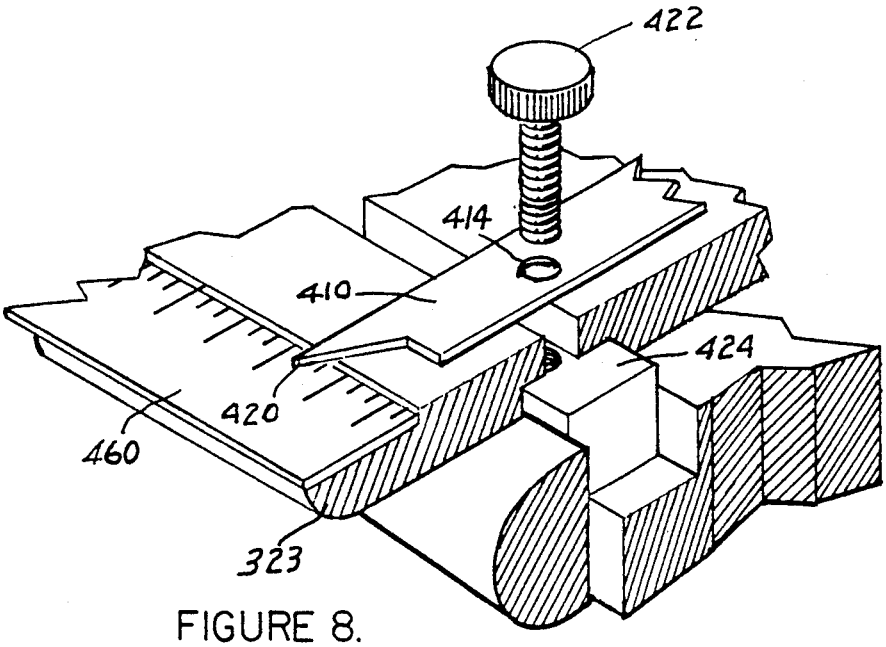
FIG. 8 shows a partial perspective view of an alternative embodiment of the graphic tape slicer of the present invention.

FIG. 8 shows in detail the adjustable width indicators and measuring scale that can be used when graphic tape of various size widths is used. Graphic tape normally comes in either 6" or 2" widths, but the present invention can accommodate ny size graphic tape up to 6" in width. If graphic tape is to be sliced that has a width smaller than 6", then the left side width indicator 410 and the right side width indicator (not shown) can be manually positioned along the top plate 323 to act as width indicators for the smaller width tape. In order to permit exact reproductions of sliced graphic tape, a measuring scale 460 is disposed along the top of the graphic tape slicer 310 and each side width indicator is provided with an associated scale marker 420 to locate the preferred position on the measuring scale 460.

In order to position the width indicator 410, a set screw 422 that passes through an opening 414 in the width indicator 410 is loosened from its mounting in a positioning block 424. The width indicator 410 can then be moved along the measuring scale 460 to the exact width of cut that is desired. The set screw 422 is then tightened into the positioning block 424 to hold the width indicator 410 in a locked position. A similar configuration (not shown) may be provided adjacent the right side wall of the graphic tape slicer 310.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A graphic tape slicer comprising:

(a) a generally rectangular frame having a front, a left side wall and a right side wall, (b) a back cross support and a front cross support disposed between the side walls, (c) a cutting blade holder disposed between the side walls and supported by the front and back cross supports, (d) a cutting blade mounted on the cutting blade holder operatively positioned to engage a length of graphic tape to be sliced, (e) a tape extraction roller disposed at the front of the frame, (f) a bottom pulley mounted on the tape extraction roller, (g) a top pulley mounted on a side wall and having a threaded rod attached thereto, said threaded rod engaging the cutting blade holder, and (h) a drive belt connecting the bottom pulley and the top pulley whereby as the graphic tape is extracted through the graphic tape slicer, the extraction roller causes the bottom pulley to rotate which causes the top pulley to rotate through the action of the drive belt which causes the threaded rod to rotate which effects a lateral movement of the cutting blade across the width of the graphic tape effecting an oblique slice in the graphic tape.

2. The graphic tape slicer of claim 1 further including a rear tape guide disposed between the side walls.

3. The graphic tape slicer of claim 1 further including a front tape guide disposed between the side walls.

4. The graphic tape slicer of claim 1 wherein the cutting blade holder has a first blade support arm that engages the front cross support and a second blade support arm that engages the back cross support.

5. The graphic tape slicer of claim 1 wherein the tape extraction roller has a plurality of friction rings mounted thereon.

6. The graphic tape slicer of claim 1 wherein the tape extraction roller is pivotally mounted to a side wall by a roller support.

7. The graphic tape slicer of claim 6 wherein a roller support is pivotally mounted to each side wall.

8. The graphic tape slicer of claim 6 wherein a limit post is mounted on the side wall to limit the pivotal movement of the extraction roller.

9. The graphic tape slicer of claim 1 wherein the tape extraction roller has a handle mounted at one end thereof for manually turning the roller.

10. A graphic tape slicer comprising:

(a) a generally rectangular frame having a front, a left side wall and a right side wall, (b) a guide bar disposed between the side walls, (c) a cutting blade holder mounted on the guide bar the cutting blade holder including a set screw mounted thereon for positioning the cutting blade holder at a fixed position along the length of the guide bar, (d) a cutting blade mounted on the cutting blade holder operatively positioned to engage a length of graphic tape to be sliced, (e) a tape extraction roller disposed at the front of the frame, (f) a bottom pulley mounted on the tape extraction roller, (g) a top pulley mounted on a side wall and having a threaded rod attached thereto, said threaded rod engaging the cutting blade holder, and (h) a drive belt connecting the bottom pulley and the top pulley whereby as the graphic tape is extracted through the graphic tape slicer, the extraction roller causes the bottom pulley to rotate which causes the top pulley to rotate through the action of the drive belt which causes the threaded rod to rotate which effects a lateral movement of the cutting blade across the width of the graphic tape effecting an oblique slice in the graphic tape.

11. A graphic tape slicer comprising:

(a) a generally rectangular frame having a front, a left side wall and a right side wall, (b) a guide bar disposed between the side walls, (c) a cutting blade holder mounted on the guide bar, (d) a cutting blade mounted on the cutting blade holder operatively positioned to engage a length of graphic tape to be sliced, (e) a tape extraction roller disposed at the front of the frame, the tape extraction roller having a plurality of friction rings mounted thereon, (f) a bottom pulley mounted on the tape extraction roller, (g) a top pulley mounted on a side wall and having a threaded rod attached thereto, said threaded rod engaging the cutting blade holder, and (h) a drive belt connecting the bottom pulley and the top pulley whereby as the graphic tape is extracted through the graphic tape slicer, the extraction roller causes the bottom pulley to rotate which causes the top pulley to rotate through the action of the drive belt which causes the threaded rod to rotate which effects a lateral movement of the cutting blade across the width of the graphic tape effecting an oblique slice in the graphic tape.

12. A graphic tape slicer comprising:

(a) a generally rectangular frame having a front, a left side wall and a right side wall, (b) a guide bar disposed between the side walls, (c) a cutting blade holder mounted on the guide bar, (d) a cutting blade mounted on the cutting blade holder operatively positioned to engage a length of graphic tape to be sliced, (e) a tape extraction roller disposed at the front of the frame, the tape extraction roller being pivotally mounted to a side wall by a roller support, (f) a bottom pulley mounted on the tape extraction roller, (g) a top pulley mounted on a side wall and having a threaded rod attached thereto, said threaded rod engaging the cutting blade holder, and (h) a drive belt connecting the bottom pulley and the top pulley whereby as the graphic tape is extracted through the graphic tape slicer, the extraction roller causes the bottom pulley to rotate which causes the top pulley to rotate through the action of the drive belt which causes the threaded rod to rotate which effects a lateral movement of the cutting blade across the width of the graphic tape effecting an oblique slice in the graphic tape.

13. The graphic tape slicer of claim 12 wherein a roller support is pivotally mounted to each side wall.

14. The graphic tape slicer of claim 12 wherein a limit post is mounted on a side wall to limit the pivotal movement of the extraction roller.

15. A graphic tape slicer comprising:

(a) a generally rectangular frame having a front, a left side wall and a right side wall, (b) a guide bar disposed between the side walls, (c) a cutting blade holder mounted on the guide bar, (d) a cutting blade mounted on the cutting blade holder operatively positioned to engage a length of graphic tape to be sliced, (e) a tape extraction roller disposed at the front of the frame, the tape extraction roller having a handle mounted at one end thereof for manually turning the roller, (f) a bottom pulley mounted on the tape extraction roller, (g) a top pulley mounted on a side wall and having a threaded rod attached thereto, said threaded rod engaging the cutting blade holder, and (h) a drive belt connecting the bottom pulley and the top pulley whereby as the graphic tape is extracted through the graphic tape slicer, the extraction roller causes the bottom pulley to rotate which causes the top pulley to rotate through the action of the drive belt which causes the threaded rod to rotate which effects a lateral movement of the cutting blade across the width of the graphic tape effecting an oblique slice in the graphic tape.

16. A graphic tape slicer comprising:

(a) a generally rectangular frame having a front, a left side wall and a right side wall, (b) a guide bar disposed between the side walls, (c) a cutting blade holder mounted on the guide bar, (d) a cutting blade mounted on the cutting blade holder operatively positioned to engage a length of graphic tape to be sliced, (e) a tape extraction roller disposed at the front of the frame, (f) a bottom pulley mounted on the tape extraction roller, (g) a top pulley mounted on a side wall and having a threaded rod attached thereto, said threaded rod engaging the cutting blade holder, (h) a drive belt connecting the bottom pulley and the top pulley, and (i) a tension roller mounted on a side wall to tension the graphic tape as it is pulled through the graphic tape slicer whereby as the graphic tape is extracted through the graphic tape slicer, the extraction roller causes the bottom pulley to rotate which causes the top pulley to rotate through the action of the drive belt which causes the threaded rod to rotate which effects a lateral movement of the cutting blade across the width of the graphic tape effecting an oblique slice in the graphic tape.

17. The graphic tape slicer of claim 16 wherein a tension spring is connected to the tension roller.

18. A graphic tape slicer comprising:

(a) a generally rectangular frame having a front, a left side wall and a right side wall, (b) a guide bar disposed between the side walls, (c) a cutting blade holder mounted on the guide bar, (d) a cutting blade mounted on the cutting blade holder operatively positioned to engage a length of graphic tape to be sliced, (e) a tape extraction roller disposed at the front of the frame, (f) a bottom pulley mounted on the tape extraction roller, (g) a top pulley mounted on a side wall and having a threaded rod attached thereto, said threaded rod engaging the cutting blade holder, (h) a drive belt connecting the bottom pulley and the top pulley, and (i) an idler roll mounted in proximity to the tape extraction roller whereby as the graphic tape is extracted through the graphic tape slicer, the extraction roller causes the bottom pulley to rotate which causes the top pulley to rotate through the action of the drive belt which causes the threaded rod to rotate which effects a lateral movement of the cutting blade across the width of the graphic tape effecting an oblique slice in the graphic tape.

19. A graphic tape slicer comprising:

(a) a generally rectangular frame having a front, a left side wall and a right side wall, (b) a guide bar disposed between the side walls, (c) a cutting blade holder mounted on the guide bar, (d) a cutting blade mounted on the cutting blade holder operatively positioned to engage a length of graphic tape to be sliced, (e) a tape extraction roller disposed at the front of the frame, (f) a bottom pulley mounted on the tape extraction roller, (g) a top pulley mounted on a side wall and having a threaded rod attached thereto, said threaded rod engaging the cutting blade holder, (h) a drive belt connecting the bottom pulley and the top pulley, and (i) adjustable width indicators mounted on the frame to position graphic tape of different widths whereby as the graphic tape is extracted through the graphic tape slicer, the extraction roller causes the bottom pulley to rotate which causes the top pulley to rotate through the action of the drive belt which causes the threaded rod to rotate which effects a lateral movement of the cutting blade across the width of the graphic tape effecting an oblique slice in the graphic tape.

20. The graphic tape slicer of claim 19 further including a scale mounted on the frame associated with the adjustable width indicators.

21. A graphic tape slicer for slicing graphic tape travelling in a path through the slicer comprising:

(a) a generally rectangular frame having a front, a left side wall and a right side wall, a back cross support and a front cross support disposed between the side walls, (b) means fixedly attached to the frame perpendicular to the path of travel for mounting a cutting blade holder between the side walls and supported by the front and back cross supports on the frame, said cutting blade holder being mounted for reciprocating movement relative to the frame, (c) a cutting blade mounted on the cutting blade holder operatively positioned to engage a length of graphic tape to be sliced, (d) means for extracting graphic tape through the frame, and (e) means for moving the cutting blade across the width of the graphic tape effecting a slice in the graphic tape at an angle oblique to the width of the graphic tape.

22. The graphic tape slider of claim 21 wherein the means for extracting graphic tape comprises a tape extraction roller disposed at the front of the frame.

23. The graphic tape slicer of claim 22 wherein the means for moving the cutting blade comprises:

(a) a bottom pulley mounted on the tape extraction roller, (b) a top pulley mounted on a side wall and having a threaded rod attached thereto, said threaded rod engaging the cutting blade holder, and (c) a drive belt connecting the bottom pulley and the top pulley whereby as the graphic tape is extracted through the graphic tape slicer, the extraction roller causes the bottom pulley to rotate which causes the top pulley to rotate through the action of the drive belt which causes the threaded rod to rotate which effects a lateral movement of the cutting blade across the width of the graphic tape effecting an oblique slice in the graphic tape.

24. The graphic tape slicer of claim 23 further including a rear tape guide disposed between the side walls.

25. The graphic tape slicer of claim 23 further including a front tape guide disposed between the side walls.

26. The graphic tape slicer of claim 21 wherein the cutting blade holder has a first blade support arm that engages the front cross support and a second blade support arm that engages the back cross support.

27. The graphic tape slicer of claim 23 wherein the tape extraction roller has a plurality of friction rings mounted thereon.

28. The graphic tape slicer of claim 23 wherein the tape extraction roller is pivotally mounted to a side wall by a roller support.

29. The graphic tape slicer of claim 28 wherein a roller support is pivotally mounted to each side wall.

30. The graphic tape slicer of claim 28 wherein a limit post is mounted on the side wall to limit the pivotal movement of the extraction roller.

31. The graphic tape slicer of claim 23 wherein the tape extraction roller has a handle mounted at one end thereof for manually turning the roller.

32. The graphic tape slicer of claim 21 wherein the means for mounting a cutting blade holder is a guide bar mounted on the frame.

33. The graphic tape slicer of claim 32 wherein the frame has side walls and guide bar is disposed between the side walls.

34. The graphic tape slicer of claim 33 wherein each end of the guide bar is beveled and mounted in an associated aperture in each side wall.

35. The graphic tape slicer of claim 34 wherein the beveled end of the guide bar is a hexagonal cross-section.

36. The graphic tape slicer of claim 32 wherein the frame has a front and the means for extracting graphic tape comprises a tape extraction roller disposed at the front of the frame.

37. The graphic tape slicer of claim 36 wherein the means for moving the cutting blade comprises:

(a) a first pulley mounted on the tape extraction roller, (b) a second pulley mounted on a side wall and having a threaded rod attached thereto, said threaded rod engaging the cutting blade holder, and (c) a drive belt connecting the pulleys whereby as the graphic tape is extracted through the graphic tape slicer, the threaded rod effects a lateral movement of the cutting blade across the width of the graphic tape effecting an oblique slice in the graphic tape.

38. The graphic tape slicer of claim 21 further including a rear tape guide disposed between the side walls.

39. The graphic tape slicer of claim 21 further including a front tape guide disposed between the side walls.

40. The graphic tape slicer of claim 21 wherein the cutting blade holder has a blade support arm that engages each cross support.

41. The graphic tape slicer of claim 22 wherein the tape extraction roller has a plurality of friction rings mounted thereon.

42. The graphic tape slicer of claim 22 wherein the tape extraction roller is pivotally mounted to a side wall by a roller support.

43. The graphic tape slicer of claim 42 wherein a roller support is pivotally mounted to each side wall.

44. The graphic tape slicer of claim 42 wherein a limit post is mounted on the side wall to limit the pivotal movement of the extraction roller.

45. The graphic tape slicer of claim 22 wherein the tape extraction roller has a handle mounted at one end thereof for manually turning the roller.

46. The graphic tape slicer of claim 21 further including adjustable width indicators mounted on the frame to position graphic tape of different widths.

47. The graphic tape slicer of claim 46 further including a scale mounted on the frame associated with the adjustable width indicators.

* * * * *